US005515663A

United States Patent [19]

Allgeier, Sr. et al.

[11] Patent Number: 5,515,663

[45] Date of Patent: May 14, 1996

[54] METHOD OF REFILLING INK-JET PRINTER CARTRIDGES

[75] Inventors: Christopher L. Allgeier, Sr., Louisville; Ryan M. Sell, Frankfort, both of Ky.

[73] Assignee: Nu-Kote International, Inc., Rochester, N.Y.

[21] Appl. No.: 223,768

[22] Filed: Apr. 6, 1994

[51] Int. Cl.[6] ..... B65B 7/28

[52] U.S. Cl. ..... 53/467; 53/489; 53/468; 53/473; 347/87

[58] Field of Search ..... 53/467, 468, 473, 53/489; 101/364; 347/87

[56] References Cited

U.S. PATENT DOCUMENTS

| | | | |
|---|---|---|---|
| 4,419,677 | 12/1983 | Kasugayana | 347/87 |
| 4,589,000 | 5/1986 | Kato et al. | 347/87 |
| 4,633,923 | 1/1987 | Hinzmann | 141/116 |
| 4,885,595 | 12/1989 | Kaplinsky et al. | 346/140 R |
| 4,945,956 | 8/1990 | Bueyuekgueclue et al. | 141/67 |
| 5,199,470 | 4/1993 | Goldman | 141/1 |
| 5,280,300 | 1/1994 | Fong et al. | 347/87 |
| 5,329,294 | 7/1994 | Ontawar et al. | 347/87 |

FOREIGN PATENT DOCUMENTS

| | | | |
|---|---|---|---|
| 567308 | 9/1993 | United Kingdom | 347/87 |

OTHER PUBLICATIONS

JetFill HP 51626A Print Cartridge Refilling Directions.

American Inkjet System for Priming the 51626A Cartridge Instructions.

*Primary Examiner*—John Sipos
*Assistant Examiner*—Ed Tolan
*Attorney, Agent, or Firm*—Fay, Sharpe, Beall, Fagan, Minnich & McKee

[57] ABSTRACT

A new method of refilling ink into an empty ink-jet printer cartridge is intended to minimize leakage and waste during the refilling process. A fill hole of the printer cartridge is opened and a predetermined quantity of ink is introduced therethrough with, for example, a first syringe. Air is then introduced into inflatable bladders provided in the printer cartridge with a second tool, preferably a second syringe. The amount of air is carefully measured to correspond with the predetermined ink quantity so that no overflow occurs. The fill hole remains open to atmosphere during the air introduction step. While the syringe is still in place, the fill opening is then closed with a new plug and thereafter the second syringe removed from the equalize opening. This exerts a slight negative pressure which acts to provide a suction force and urge any ink in open ports inwardly into the housing, thus minimizing overall leakage and waste during the refill process.

12 Claims, 3 Drawing Sheets

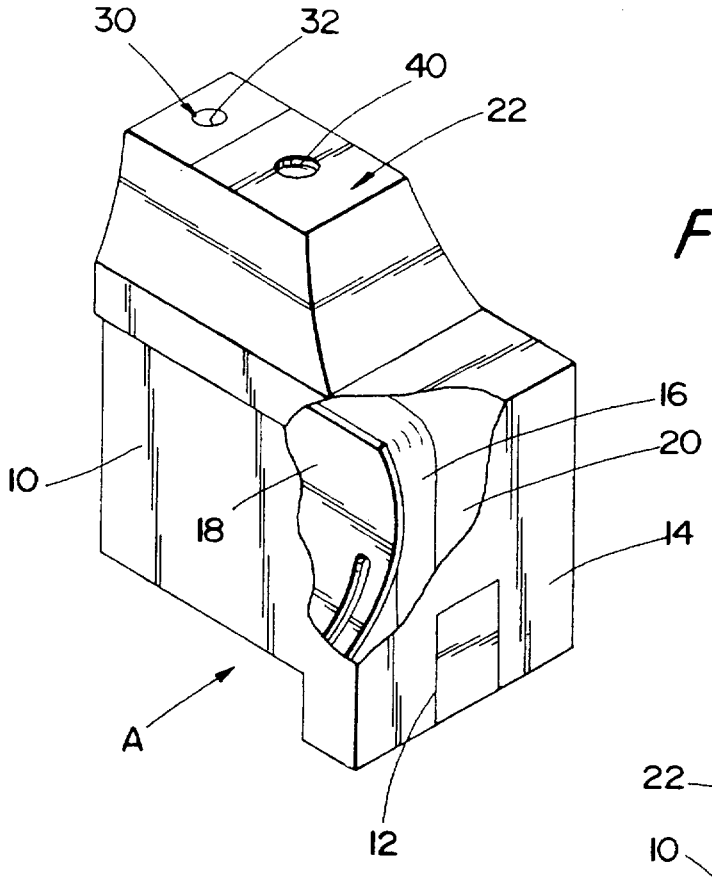
Fig. 1
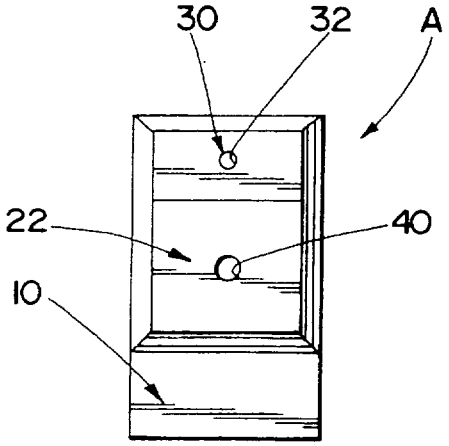
Fig. 2
Fig. 3
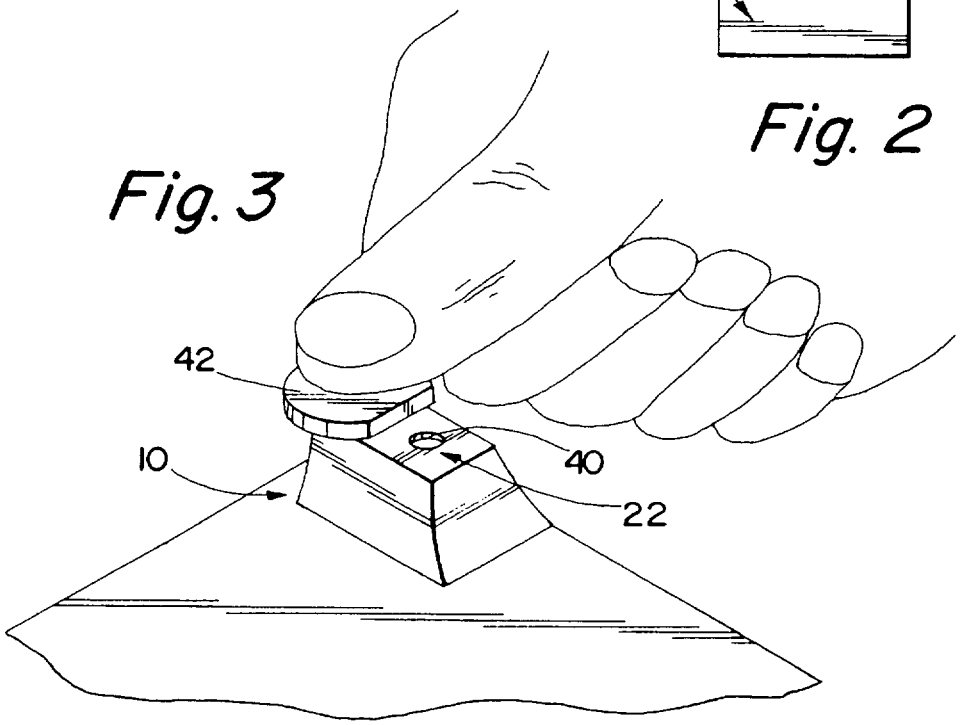

METHOD OF REFILLING INK-JET PRINTER CARTRIDGES

BACKGROUND OF THE INVENTION

This invention pertains to the art of printer cartridges and more particularly to ink-jet printer cartridges. The invention is particularly applicable to a method of refilling empty or spent ink-jet printer cartridges and will be described with particular reference thereto. However, it will be appreciated that the invention has broader applications and may be advantageously employed in other related environments and applications.

Ink-jet printer technology typically employs a replaceable cartridge or housing that carries a quantity of ink that is formed into droplets for dispensing through a nozzle and onto a printing medium such as paper. For example, ink droplets are formed in response to an electrical signal that heats the ink, creating an ink vapor bubble that pushes ink out of the nozzle. An electrical resistive element heats the ink extremely rapidly so that ink can be dispensed in a matter of milliseconds.

Related structures can be used to dispense ink droplets onto the paper. For example, a piezoelectric crystal can be used to dispense the ink droplets. As is well known, impressing an electrical signal on the crystal results in a dimensional change. The dimensional change of the crystal can be advantageously used to regulate droplets of ink from the cartridge. Likewise, when the electrical signal is removed, the crystal reverts to its original state.

Additional details of the ink-jet printer technology are well known in the art. Moreover, since the structure and operation of the replaceable cartridges is well known in the art, further discussion in that regard herein is deemed unnecessary.

The subject invention is directed to a method of refilling an empty printer cartridge of this type. Existing methods for refilling such cartridges suffer from a number of drawbacks. Particularly, a portion of the newly introduced refill ink is expelled from the cartridge and wasted with known refill processes. Aside from the mere waste of expelled ink, the user is faced with a mess. In fact, suppliers of refill kits recognize this problem and attempt to resolve it by instructing the user to place the cartridge into a special holder or container during the refill procedure, providing absorbent pads or surfaces to capture the overrun ink, etc.

Yet another problem associated with prior refill processes is that the priming procedure oftentimes has to be repeated since a proper flow of ink from the cartridge does not occur. The priming procedure, at other times, results in too much ink being expelled from the printer cartridge nozzles since the pressure within the cartridge becomes too great. The tool used for priming in known refill processes does not provide a predetermined amount of air to the cartridge but instead relies on the judgment of the user with regard to introducing a proper volume of air.

Accordingly, it is desired to provide a new kit and process for refilling printer cartridges that overcomes these and other problems in an efficient, reliable manner that provides desired amounts of ink and air.

SUMMARY OF THE INVENTION

The present invention contemplates a new and improved refill kit and process that overcomes all of the above-referenced problems and others and provides a new method for refilling ink in an empty printer cartridge.

According to the present invention, the method includes opening a fill hole in the printer cartridge, introducing ink through the fill hole, introducing air into the cartridge bladders, and thereafter closing the fill hole in the printer cartridge.

According to a more limited aspect of the invention, a predetermined quantity of ink is introduced into the printer cartridge. Likewise, a predetermined quantity of air is introduced into an inflatable bladder contained in the printer cartridge.

According to yet another aspect of the invention, a new plug is then inserted into the fill hole prior to removal of a priming tool from the equalizing hole.

A principal advantage of the invention resides in a procedure that uses predetermined amounts of ink and air to refill and prime the printer cartridge.

Another advantage of the invention is found in the ability to leave the cartridge open to atmosphere during the priming step, thus not increasing the pressure inside the cartridge which normally causes leakage of ink through the print nozzles or check valve.

Still another advantage of the invention is the ability to provide a predetermined quantity of air in a single step.

Another advantage results in the fact that no additional ink is required to compensate for ink loss during priming because no loss occurs under this preferred method.

Still other advantages and benefits of the invention will become apparent to those skilled in the art upon a reading and understanding of the following detailed description.

BRIEF DESCRIPTION OF THE DRAWINGS

The invention may take physical form in certain steps, parts and arrangements of steps or parts, a preferred refill kit and method of which will be described in detail in this specification and illustrated in the accompanying drawings which form a part hereof, and wherein:

FIG. 1 is a perspective view of an ink-jet printer cartridge as commonly used in the industry, portions of which have been cut away for ease of illustration;

FIG. 2 is a top plan view of the printer cartridge of FIG. 1;

FIG. 3 is a view illustrating removal of a fill hole plug in the printer cartridge;

DETAILED DESCRIPTION OF THE PREFERRED EMBODIMENT AND METHOD OF REFILLING

Figure 4:
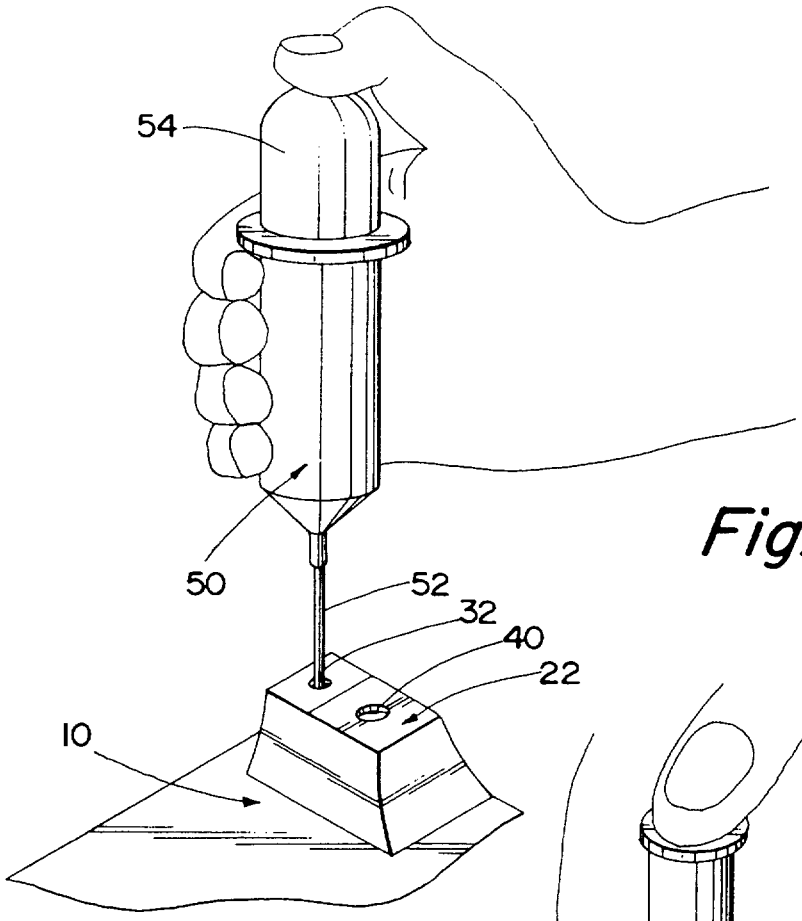
FIG. 4 illustrates the introduction of refill ink into the cartridge.

Referring now to the drawings wherein the showings are for purposes of illustrating the preferred embodiment and method of the invention only and not for purposes of limiting same, the FIGURES show a printer cartridge A that is empty and which is refilled rather than replaced by a new cartridge. More particularly, and with reference to FIG. 1, an empty printer cartridge A includes a housing 10 that has one or more dispensing nozzles 12 along a base portion 14 from which ink droplets are provided in accordance with known ink-jet technology. Contained within the housing are one or more inflatable bladders 16 that cooperate with springs 18 to provide a back pressure which retains ink droplets in the cartridge when not excited by electrical stimulus. A major portion of the housing interior defines a reservoir or cavity 20 in which the ink is stored.

With continued reference to FIG. 1, and additional reference to FIG. 2, a top portion 22 of the printer cartridge includes at least two openings that communicate with the interior of the housing. The first opening is generally referred to as the fill opening 30. As will be recognized, the fill opening is normally plugged or closed once ink is introduced into the housing. Thus, the original manufacturer seals this opening with a bead or plug 32. During operation of the printer cartridge when installed in an ink-jet printer, the fill opening, therefore, is closed.

A second opening is typically referred to as an equalize opening 40. The opening 40 communicates with the inflatable bladders 16. Thus, limited back pressure is provided within the closed reservoir by inflation of the bladders through the equalize opening. The bladders consume a greater portion of the volume in the housing as the corresponding volume of ink decreases, to maintain a stable back pressure inside the cartridge allowing it to function properly. The springs 18 normally maintain the bladders in a compressed state by urging the air outwardly through the equalize opening.

According to known methods of refilling ink-jet printer cartridges of this type, the bead or plug 32 that closes the fill opening is removed. Ink is then introduced into the housing through the fill opening, although an accurate dosage or precise quantity is not used. Rather, manufacturers of ink refill kits usually provide an excess amount of ink to compensate for expected waste and leakage. After the new ink has been inserted to refill the printer cartridge, a new fill hole plug is inserted in the opening 30. According to these prior methods, it is critical that the new plug form an airtight seal at the fill opening.

Thereafter, a priming tool such as a bulb is introduced into the equalize opening. The consumer is instructed to squeeze air from the bulb through the equalize opening so that ink is forced out through the dispensing nozzle. Thus, a small leakage of ink occurs during the priming process, and it may be necessary to repeat the priming process one or two times until a sufficient back pressure is established in the cartridge and the leakage discontinues. The consumer is warned that ink may slowly seep from the cartridge during this time period and that any excess ink can be removed by blotting the cartridge on an absorbent material.

According to the new method as shown in FIGS. 3–7, this process is modified to refill an empty printer cartridge. Turning first to FIG. 3, the fill hole plug 32 is removed from the fill opening 30. Any specialized tool 42 can be used to depress the original plug inwardly into the housing. As shown here, a preferred tool 42 has a width that approximates the width of the top portion 22 of the cartridge. The tool is generally rectangular and planar in shape with a raised dimple that protrudes from an underside thereof. The dimple is located for alignment over the fill hole plug so that exertion of downward pressure of the tool over the plug 32 will separate the plug from the cartridge top portion and urge the plug into the reservoir 20. Alternatively, if the printer cartridge has been previously refilled, the plug may be removed by pulling it outwardly from the fill hole 30 and as will become more apparent below.

Turning to FIG. 4, once the plug has been removed from the fill hole a predetermined quantity of ink is inserted into the cartridge. Preferably, a first syringe 50 has a predetermined quantity of ink. In a preferred arrangement, thirty-nine grams of ink are provided in the first syringe and dispensed into the cartridge. Of course it will be recognized that different size cartridges sold by different manufacturers may require different predetermined quantities of ink. Syringe needle 52 is inserted into the fill hole and plunger 54 depressed to dispense the predetermined quantity of ink into the cartridge. After the first syringe has been completely emptied of its contents, it is then removed from the fill hole.

Figure 5:
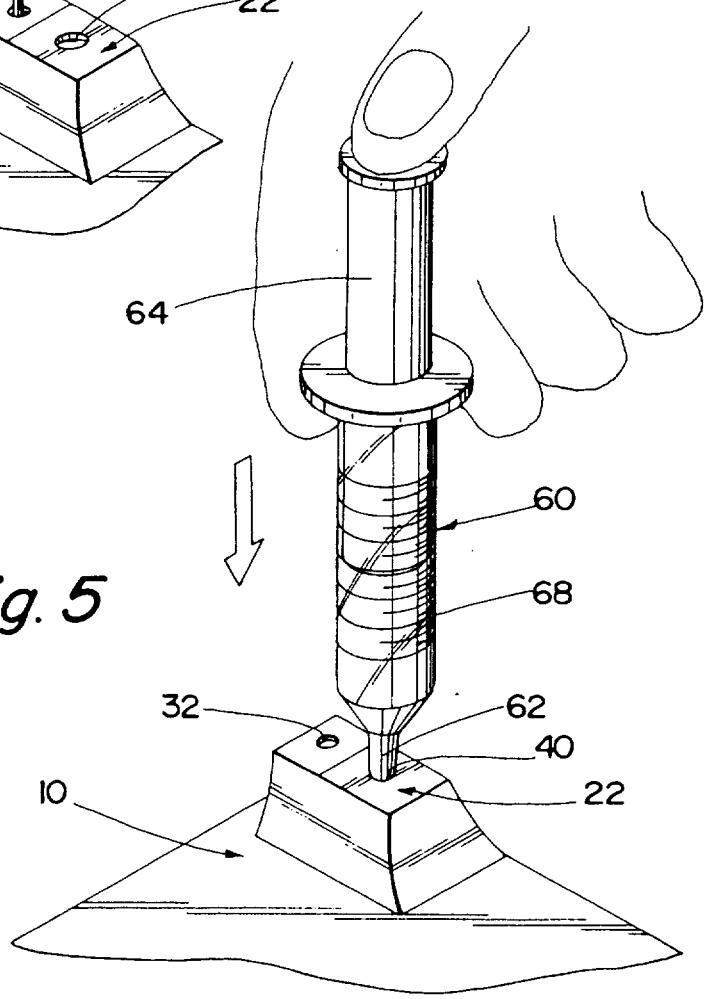
FIG. 5 demonstrates the introduction of a predetermined quantity of air into the cartridge.
Figure 6:
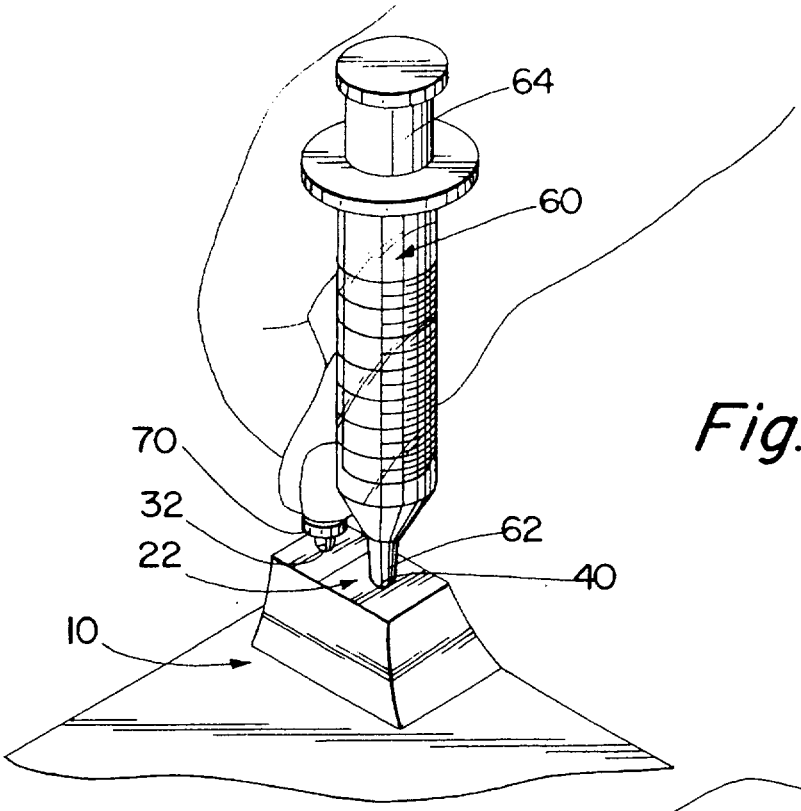
FIG. 6 shows the insertion of a new fill hole plug.
Figure 7:
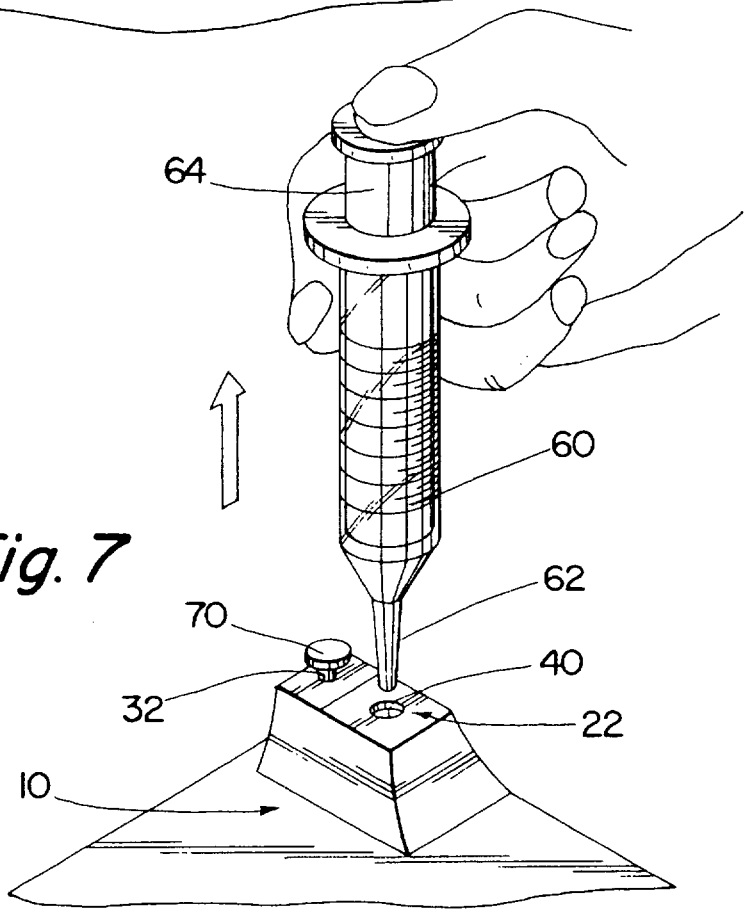
FIG. 7 shows the removal of the primer syringe.

FIG. 5 illustrates the next step in the refill process. A second syringe 60 is used for introducing air into the bladders through syringe needle 62. A plunger 64 is retracted to a predetermined mark on the reservoir 68 prior to insertion of the needle into equalize opening 40. In this manner, a preselected quantity of air will be introduced into the air bladders. The plunger is then advanced completely inwardly into the syringe to dispense the preselected quantity of air into the bladders. In the preferred arrangement, approximately seven cc's of air are introduced by the second syringe into the inflatable bladders.

It is important to note that during this air insertion step, the fill opening 30 remains open to atmosphere. It is also important that the needle 62 of the second syringe form a tight seal with the equalize opening so that the proper quantity of air is inserted into the bladders. This inflation of the bladders causes the ink level inside the cartridge to rise but, due to the premeasured quantities, the ink will not overflow from the fill hole.

With the second syringe still in place in the equalize opening, the fill hole is then closed with a new plug 70. The ink cartridge is now sealed. The second syringe can then be removed from its sealing relationship with the equalize opening. The air bladders are compressed, in part, by the springs which urge the air outwardly from the bladders through the equalize opening. This results in an associated reduction in pressure in the housing since the new plug is in place sealing the cartridge reservoir. Any ink located in ports or openings associated with the cartridge, e.g. the nozzle openings, will be urged inwardly as a result of the suction or vacuum-like effect from the decrease in the bladder size. Most importantly, ink in the print head nozzles is urged inwardly because of the slightly negative pressure developed inside the printer cartridge which eliminates the ink leakage problem associated with the known methods.

By this preferred method, empty printer cartridges can be effectively refilled without the leakage, mess and inconvenience associated with known methods. The use of predetermined amounts of ink and air, in combination with maintaining the housing open to atmospheric pressure until after air has been introduced into the bladders, results in minimal leakage from the printer cartridge.

The invention has been described with reference to the preferred embodiment and method. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A method of refilling ink in an empty printer cartridge comprising the steps of:

opening a fill hole in the printer cartridge;

introducing ink into the printer cartridge through the fill hole;

introducing air into the printer cartridge by providing a predetermined quantity of air in a syringe in an amount that prevents the ink from overflowing from the fill hole, inserting the syringe into an equalize opening of the printer cartridge, depressing a plunger of the syringe to introduce the air into inflatable bladders contained in the printer cartridge;

closing the fill hole in the printer cartridge after the air introducing step; and maintaining the syringe in the equalize opening of the printer cartridge until after the fill hole closing step.

2. The method as defined in claim 1 wherein the fill hole opening step includes the steps of positioning a tool over a fill hole plug and pushing the fill hole plug into the cartridge.

3. The method as defined in claim 1 wherein the ink introducing step includes the steps of providing a predetermined quantity of ink in a first reservoir and completely dispensing the predetermined quantity of ink into the printer cartridge.

4. The method as defined in claim 1 wherein the air introducing step includes the steps of providing a predetermined quantity of air in a second reservoir and completely dispensing the predetermined quantity of air into inflatable bladders contained in the printer cartridge.

5. The method as defined in claim 1 comprising the further step of supplying a new plug for closing the fill hole.

6. A method for refilling ink in a spent printer cartridge wherein the printer cartridge includes a housing having a fill hole through which ink may be introduced into the housing, at least one inflatable bladder in the housing that communicates with an equalize opening for introducing air into the inflatable bladder, the method comprising the steps of:

opening the fill hole in a spent printer cartridge;

introducing a predetermined quantity of ink into the housing through the opened fill hole;

introducing a predetermined quantity of air through the equalize opening and into the inflatable bladder including inserting a needle of a primer syringe into the equalize opening and depressing a plunger of the primer syringe to dispense a predetermined quantity of air into the inflatable bladder in an amount that prevents the ink from overflowing from the fill hole; and closing the fill hole after the air introducing step.

7. The method as defined in claim 6 wherein the fill hole opening step includes the step of removing an existing plug from the fill hole.

8. The method as defined in claim 6 wherein the ink introducing step includes the steps of inserting a needle of an ink refill syringe into the fill hole, depressing a plunger of the ink refill syringe to urge the predetermined quantity of ink into the housing, and removing the ink refill syringe from the housing.

9. The method as defined in claim 6 comprising the additional step of maintaining the primer syringe needle in the equalize opening until after the fill hole closing step has been completed.

10. The method as defined in claim 6 wherein the fill hole closing step includes supplying a new plug that seals the fill hole.

11. The method as defined in claim 6 wherein the air introducing step is completed after the ink introducing step.

12. The method as defined in claim 6 wherein the fill hole opening step includes the step of removing a plug from a previously refilled, empty printer cartridge.

* * * * *